US008054152B2

(12) United States Patent
Tseng et al.

(10) Patent No.: US 8,054,152 B2
(45) Date of Patent: Nov. 8, 2011

(54) TRANSFORMER

(75) Inventors: Hsiang-Yi Tseng, Taoyuan Hsien (TW); Hsin-Wei Tsai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/948,575

(22) Filed: Nov. 17, 2010

(65) Prior Publication Data

US 2011/0115595 A1 May 19, 2011

(30) Foreign Application Priority Data

Nov. 18, 2009 (TW) ..... 98139223 A

(51) Int. Cl.
*H01F 27/29* (2006.01)

(52) U.S. Cl. ..... 336/192; 336/82; 336/90

(58) Field of Classification Search ..... 336/192, 336/82, 90
See application file for complete search history.

(56) References Cited

U.S. PATENT DOCUMENTS 2,668,274 A * 2/1954 Schneider ..... 323/359
3,376,523 A * 4/1968 Kerns ..... 333/177
3,581,259 A * 5/1971 Brunside ..... 336/90
3,720,284 A * 3/1973 Myers ..... 180/287
3,858,137 A * 12/1974 Roggenkamp et al. ..... 336/90
4,027,279 A * 5/1977 Shigehara ..... 336/90
4,924,089 A * 5/1990 Caravatti ..... 250/290
5,153,550 A * 10/1992 Sugiura et al. ..... 336/192
6,078,240 A * 6/2000 Huang ..... 336/90
6,262,651 B1 * 7/2001 Miyamoto et al. ..... 336/192
6,960,772 B1 * 11/2005 Johnson et al. ..... 250/442.11
6,960,972 B2 * 11/2005 Nakamura et al. ..... 335/128
7,176,771 B2 * 2/2007 Faber et al. ..... 335/201
7,183,674 B2 * 2/2007 Koorneef et al. ..... 310/12.04
7,274,282 B2 * 9/2007 Park et al. ..... 336/192
7,301,430 B1 * 11/2007 Chan et al. ..... 336/200
7,528,694 B2 * 5/2009 Tseng et al. ..... 336/212
7,616,086 B2 * 11/2009 Kweon et al. ..... 336/208
7,646,278 B2 * 1/2010 Yang et al. ..... 336/90

* cited by examiner

*Primary Examiner* — Anh Mai
*Assistant Examiner* — Joselito Baisa
(74) *Attorney, Agent, or Firm* — Kirton & McConkie; Evan R. Witt

(57) ABSTRACT

A transformer includes a covering member, a bobbin, a primary winding coil, plural secondary winding coils, and a magnetic core assembly. The covering member includes plural pins. The bobbin is combined with the covering member, and includes a bobbin body and a channel. A first winding section and plural single-trough second winding sections are defined on the bobbin body. The single-trough second winding sections are arranged at bilateral sides of the first winding section. The channel runs through the bobbin body. The primary winding coil is wound around the first winding section of the bobbin, and connected with the pins. The secondary winding coils are wound around respective single-trough second winding sections of the bobbin. The magnetic core assembly is partially embedded into the channel of the bobbin.

11 Claims, 6 Drawing Sheets

TRANSFORMER

FIELD OF THE INVENTION

The present invention relates to a transformer, and more particularly to a transformer having plural single-trough second winding sections.

BACKGROUND OF THE INVENTION

A transformer has become an essential electronic component for voltage regulation into required voltages for various kinds of electric appliances.

Since the leakage inductance of the transformer has an influence on the electric conversion efficiency of a power converter, it is very important to control leakage inductance. In the power supply system of the new-generation electric products such as LCD televisions, leakage inductance transformers (e.g. LLC transformers) become more and more prevailing. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance. As the LCD panels become more and more large-sized and slim, many components (e.g. magnetic elements, conductive winding modules, or the like) are developed toward minimization and high electric conversion efficiency.

FIG. 1 is a schematic exploded view of a conventional leakage inductance transformer. As shown in FIG. 1, the transformer 1 comprises a bobbin 11, a covering member 12, and a magnetic core assembly 13. A primary winding coil 111 and a secondary winding coil 112 are wound around the bobbin 11. The output terminals 113, 114 of the primary and the secondary winding coils 111, 112 are directly wound and soldered on pins 115, which are perpendicularly extended from the bottom of the bobbin 11. The cover member 12 is used for partially sheltering the upper portion of the bobbin 11 in order to increase the creepage distances between the primary winding coil 111, the secondary winding coil 112 and the magnetic core assembly 13. The magnetic core assembly 13 includes middle portions 131 and leg portions 132. The middle portions 131 are accommodated within a channel 116 of the bobbin 11. The bobbin 11 is partially enclosed by the leg portions 132. Meanwhile, the transformer 1 is assembled.

As known, after the transformer 1 is assembled, an air gap (not shown) is defined between the corresponding leg portions 132. The air gap is formed between the primary winding coil 111 and a secondary winding coil 112. If the secondary winding coil 112 is in a short-circuit condition, the magnetic path possibly causes individual loops and thus the leakage inductance is increased. Under this circumstance, the leakage inductance of the transformer 1 fails to be stably controlled. In addition, after the outlet parts 113 and 114 of the primary winding coil 111 and the secondary winding coil 112 are wound around and soldered on the pins 115, each of the outlet parts 113 and 114 is usually sheathed by a tube 14. If the tube 14 is omitted, the primary winding coil 111 and the secondary winding coil 112 wound around the bobbin 11 are possibly stained with solder paste because the wire-managing groove

117 is too short or the distance between the pin 115 and the winding section of the bobbin 11 is too short. Although the use of the tube 14 could protect the primary winding coil 111 and the secondary winding coil 112 wound around the bobbin 11, there are still some drawbacks. For example, the tube 14 may be thermally damaged. The procedure of sheathing the tube 14 is time-consuming and labor-intensive. In addition, the use of the tube 14 increases the cost of the transformer.

Therefore, there is a need of providing an improved transformer so as to obviate the drawbacks encountered from the prior art.

SUMMARY OF THE INVENTION

It is an object of the present invention to provide a transformer having plural single-trough second winding sections. Plural secondary winding coils are wound around respective single-trough second winding sections, so that the winding means and the magnetic path are changed.

Another object of the present invention provides a transformer having an air gap disposed over the primary winding coil, thereby stably controlling the leakage inductance.

A further object of the present invention provides a transformer having increased winding space, enhanced electric conversion efficiency, and reduced heat generation.

In accordance with an aspect of the present invention, there is provided a transformer. The transformer includes a covering member, a bobbin, a primary winding coil, plural secondary winding coils, and a magnetic core assembly. The covering member includes plural pins. The bobbin is combined with the covering member, and includes a bobbin body and a channel. A first winding section and plural single-trough second winding sections are defined on the bobbin body. The single-trough second winding sections are arranged at bilateral sides of the first winding section. The channel runs through the bobbin body. The primary winding coil is wound around the first winding section of the bobbin, and connected with the pins. The secondary winding coils are wound around respective single-trough second winding sections of the bobbin. The magnetic core assembly is partially embedded into the channel of the bobbin.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
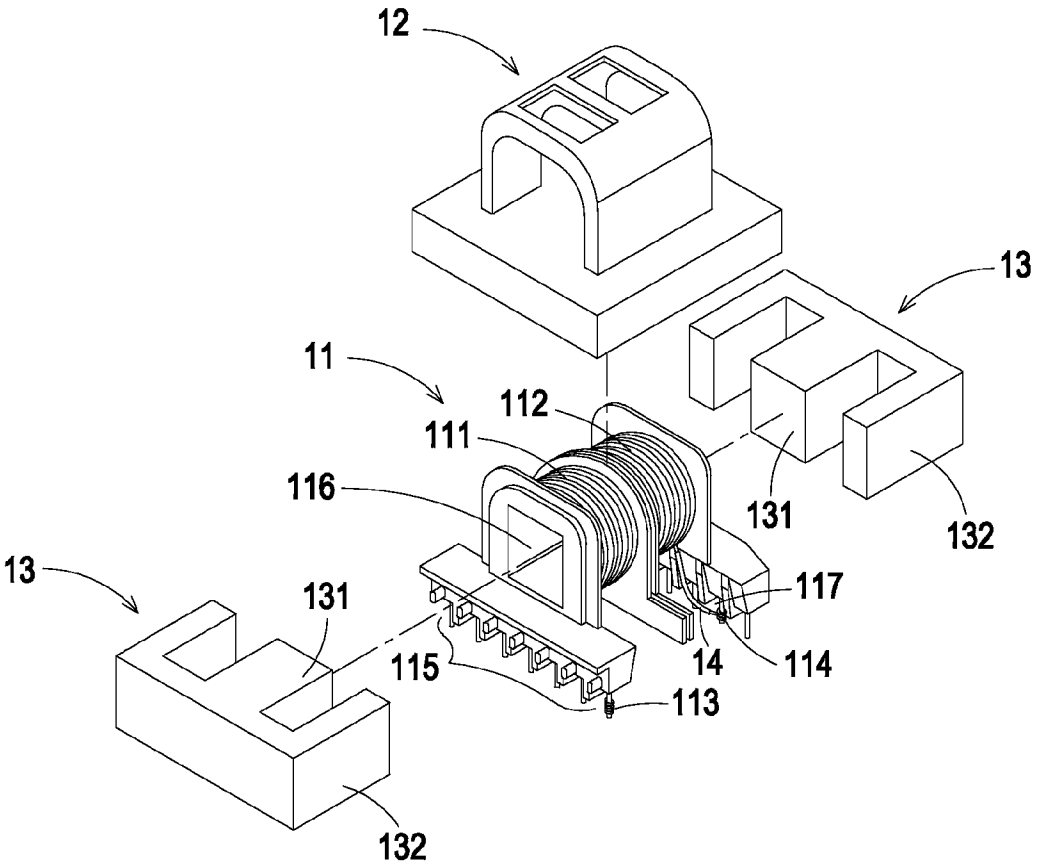
FIG. 1 PRIOR ART
FIG. 1 is a schematic exploded view of a conventional transformer.
Figure 2A:
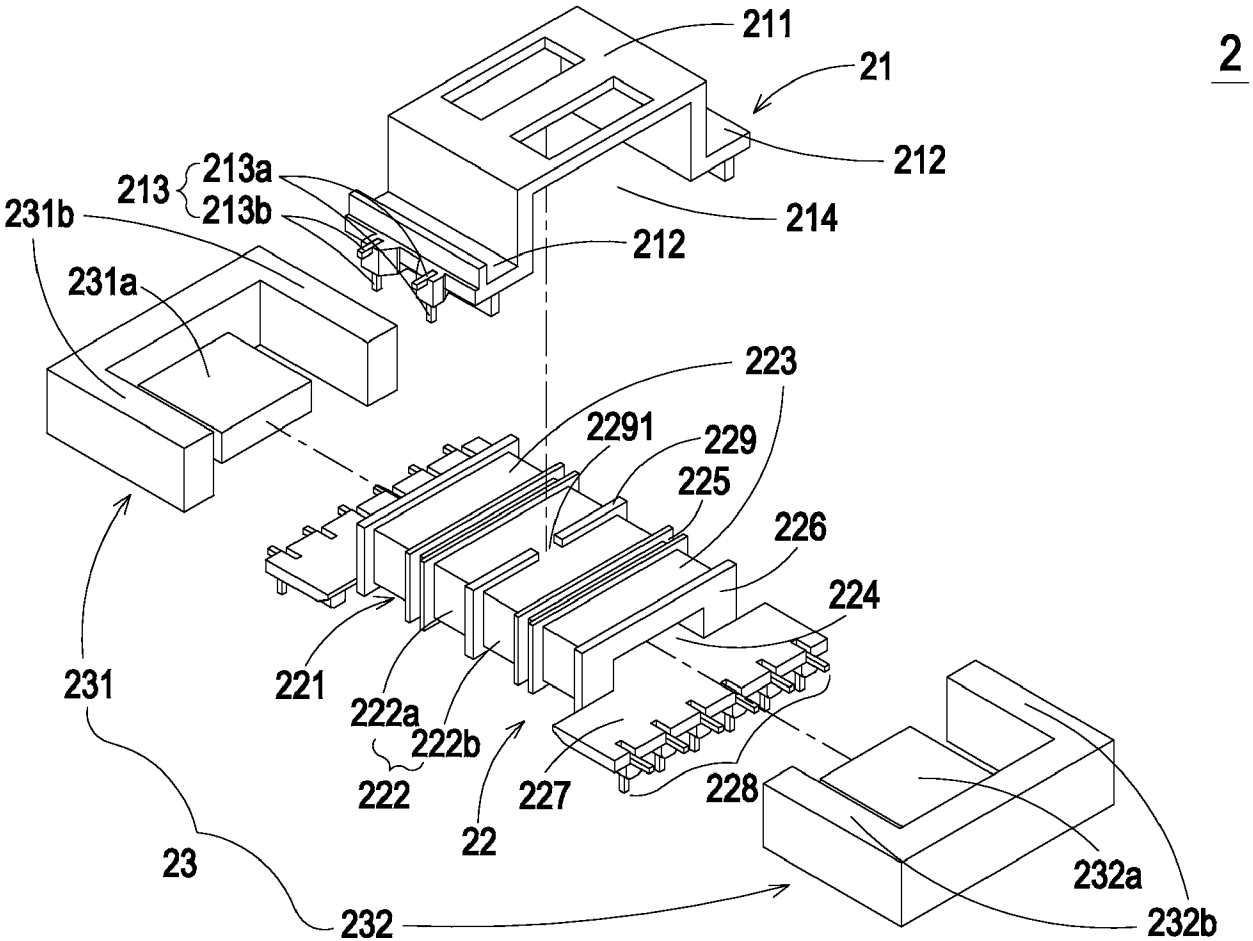
FIG. 2A is a schematic exploded view illustrating a transformer according to a first embodiment of the present invention, in which the winding coils are not shown.

FIG. 2A is a schematic exploded view illustrating a transformer according to a first embodiment of the present invention, in which the winding coils are not shown. As shown in FIG. 2A, the transformer 2 comprises a covering member 21, a bobbin 22, a magnetic core assembly 23, a primary winding coil 24, and plural secondary winding coils 25 (see FIG. 2B). The covering member 21 is combined with the bobbin 22. The covering member 21 comprises a covering member body 211, a recess 212 and plurality pins 213. In this embodiment, the plural pins 213 comprise a first pin 213*a* and a second pin 213*b*. The covering member body 211 comprises a receptacle 214. The recess 212 is disposed beside the covering member body 211. The pins 213 are disposed outside the recess 212. The bobbin 22 comprises a bobbin body 221, a channel 224, plural partition plates 225, two side plates 226, and two connecting bases 227. The channel 224 runs through the bobbin body 221. In this embodiment, the bobbin body 221 is substantially rectangular. The side plates 226 are disposed on two opposite sides of the bobbin body 221. The partition plates 225 are disposed on the bobbin body 221. The partition plates 225 are arranged between the two side plates 226 and substantially parallel to the two side plates 226. In this embodiment, the bobbin 22 has two partition plates 225. The number of the partition plates 225 could be varied as required. By the side plates 226 and the partition plates 225, a first winding section 222 and two single-trough second winding sections 223 are defined on the surface of the bobbin body 221. The first winding section 222 is arranged in the middle of the bobbin body 221. The two single-trough second winding sections 223 are respectively arranged at bilateral sides of the first winding section 222. The two connecting bases 227 are extended from external surfaces of the side plates 226. Plural pins 228 are extended from the connecting bases 227. Via the pins 228, the secondary winding coils 25 are be electrically connected with a circuit board (not shown).

In some embodiments, the bobbin 22 further comprises a central separation plate 229. The central separation plate 229 is arranged in the first winding section 222. By the central separation plate 229, the first winding section 222 is divided into a first portion 222*a* and a second portion 222*b*, so that the first winding section 222 is a multi-trough winding section. In addition, the central separation plate 229 further includes a notch 2291. During the procedure of winding the primary winding coil 24 around the first winding section 222, the primary winding coil 24 could be wound from the first portion 222*a* to the second portion 222*b* (or from the second portion 222*b* to the first portion 222*a*) through the notch 2291. In some embodiments, the central separation plate 229 is omitted, so that the first winding section 222 is also a single-trough winding section.

Figure 3:
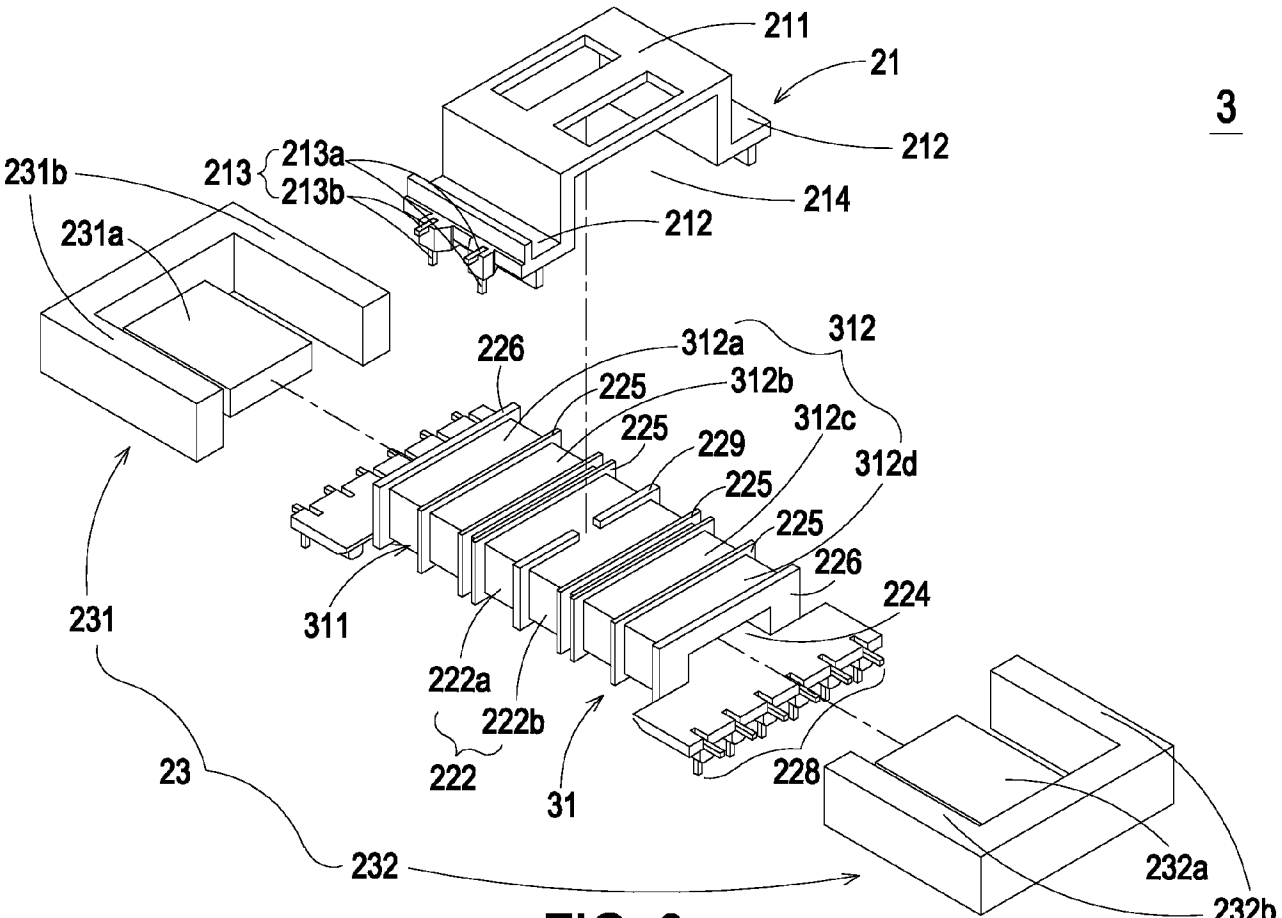
FIG. 3 is a schematic exploded view illustrating a transformer according to a second embodiment of the present invention.

In the embodiment of FIG. 2A, the transformer 2 has two single-trough second winding sections 223. It is noted that the number of the single-trough second winding sections 223 could be varied as required. FIG. 3 is a schematic exploded view illustrating a transformer according to a second embodiment of the present invention. As shown in FIG. 3, one first winding section 222 and four single-trough second winding sections 312 are defined on the surface of the bobbin body 311 of the bobbin 31 by four partition plates 225 and the side plates 226. The four single-trough second winding sections 312 include the second winding sections 312*a*, 312*b*, 312*c* and 312*d*. Correspondingly, four secondary winding coils (not shown) are respectively wound around the four single-trough second winding sections.

Please refer to FIG. 2A again. The magnetic core assembly 23 comprises a first magnetic part 231 and a second magnetic part 232. The first magnetic part 231 of the magnetic core assembly 23 comprises a middle portion 231*a* and two leg portions 231*b*. The second magnetic part 232 of the magnetic core assembly 23 also comprises a middle portion 232*a* and two leg portions 232*b*. The first magnetic part 231, the second magnetic part 232, the covering member 21 and the bobbin 22 are combined together to assemble the transformer 2. In this embodiment, the first magnetic part 231 and the second magnetic part 232 are E cores, so that the magnetic core assembly 23 is an EE-type magnetic core assembly. Alternatively, the first magnetic part 231 and the second magnetic part 232 of the magnetic core assembly 23 collectively define a UI-type magnetic core assembly or an EI-type magnetic core assembly.

Figure 2B:
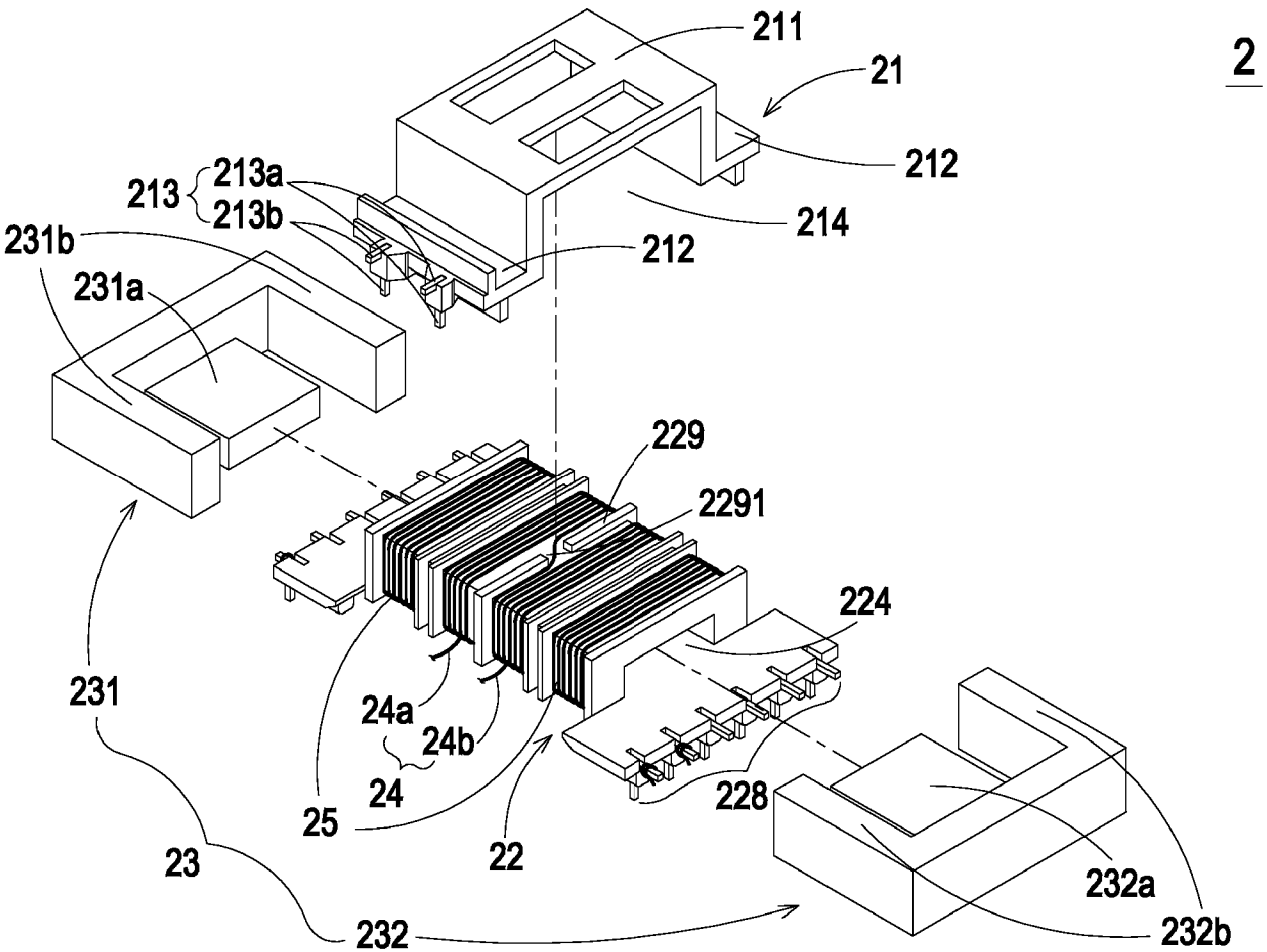
FIG. 2B is a schematic exploded view illustrating the transformer of FIG. 2A, in which the winding coils are shown.

FIG. 2B is a schematic exploded view illustrating the transformer of FIG. 2A, in which the winding coils are shown. In this embodiment, the primary winding coil 24 is a conductive wire that is wound around the first winding section 222 of the bobbin 221. The primary winding coil 24 has two outlet parts 24*a* and 24*b*. For winding the primary winding coil 24, the outlet part 24*a* is firstly wound around the first portion 222*a* of the first winding section 222 and then wound around the second portion 222*b* through the notch 2291 of the central separation plate 229. Then, the covering member 21 is combined with the bobbin 22. Then, the outlet parts 24*a* and 24*b* of the primary winding coil 24 are respectively wound around and soldered on the first pin 213*a* and the second pin 213*b* of the covering member 21 (see FIG. 2C). Since the outlet parts 24*a* and 24*b* of the primary winding coil 24 are wound around the pins 213 of the covering member 21, the winding space of the first winding section 222 is increased. In other words, since the turn number of the primary winding coil 24 wound around the first winding section 222 is increased, the electric conversion efficiency is enhanced. In addition, the heat generated during operation of the transformer 2 is reduced.

It is noted that the winding direction of the primary winding coil 24 could be varied as required. In some embodiments, the outlet part 24*b* is firstly wound around the second portion 222*a* of the first winding section 222 and then wound around the first portion 222*a* through the notch 2291 of the central separation plate 229. The secondary winding coils 25 are wound around respective single-trough second winding sections 223 of the bobbin body 221. That is, each secondary winding coil 25 is wound around a corresponding single-trough second winding section 223. The two outlet parts of each secondary winding coil 25 are soldered on the pins 228 of the two connecting bases 227 (see FIG. 2D).

Figure 2C:
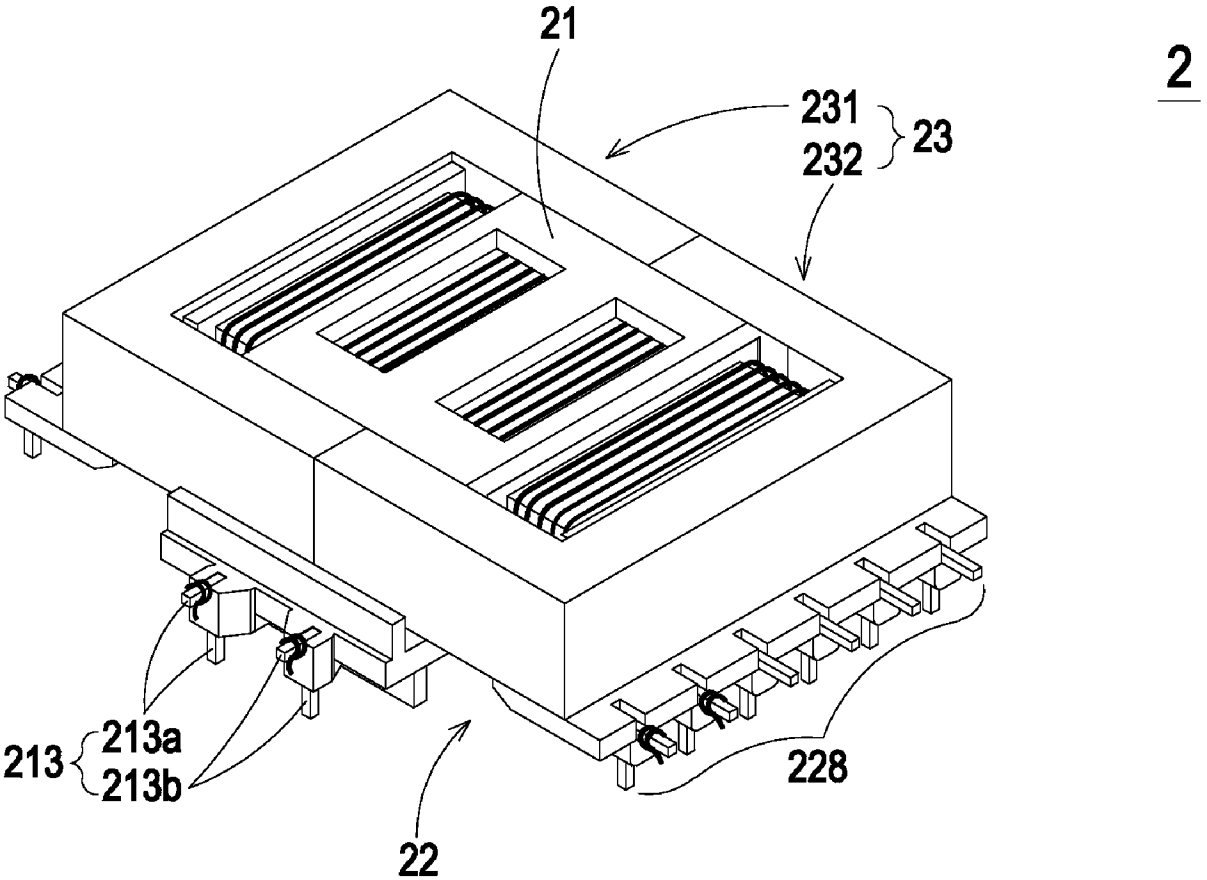
FIG. 2C is a schematic assembled view illustrating the transformer of FIG. 2B.

Hereinafter, a process of assembling the transformer 2 will be illustrated with reference to FIGS. 2B, 2C and 2D. First of all, the primary winding coil 24 is wound around the first winding section 222 of the bobbin body 21, and the secondary winding coils 25 are wound around respective single-trough second winding sections 223 of the bobbin body 221. Then, the outlet parts of each secondary winding coil 25 are fixed on the pins 228 of the connecting base 227. Next, the covering member 21 is combined with the bobbin 22, so that a portion of the bobbin body 221 and the primary winding coil 24 are accommodated within the receptacle 214 of the covering member 21. Next, the outlet parts 24*a* and 24*b* of the primary winding coil 24 are respectively fixed on the first pin 213*a* and the second pin 213*b* of the covering member 21. Afterwards, the middle portion 231*a* of the first magnetic part 231 and the middle portion 232*a* of the second magnetic part 232 are embedded into the channel 224 of the bobbin 22. As a consequence, the periphery of the bobbin 22 is enclosed by the leg portions 231*b* and 232*b*, and the leg portions 231*b* and 232*b* are partially accommodating within the recess 212. Meanwhile, the transformer 2 is assembled. Since the air gap (not shown) between the leg portions 231*b* and 232*b* is over the primary winding coil 24, the leakage inductance of the transformer 2 is not influenced by the air gap. By adjusting the distance between the primary winding coil 24 and secondary winding coil 25 or increasing the turn numbers of the winding coils, the leakage inductance of the transformer 2 could be stably controlled.

Figure 2D:
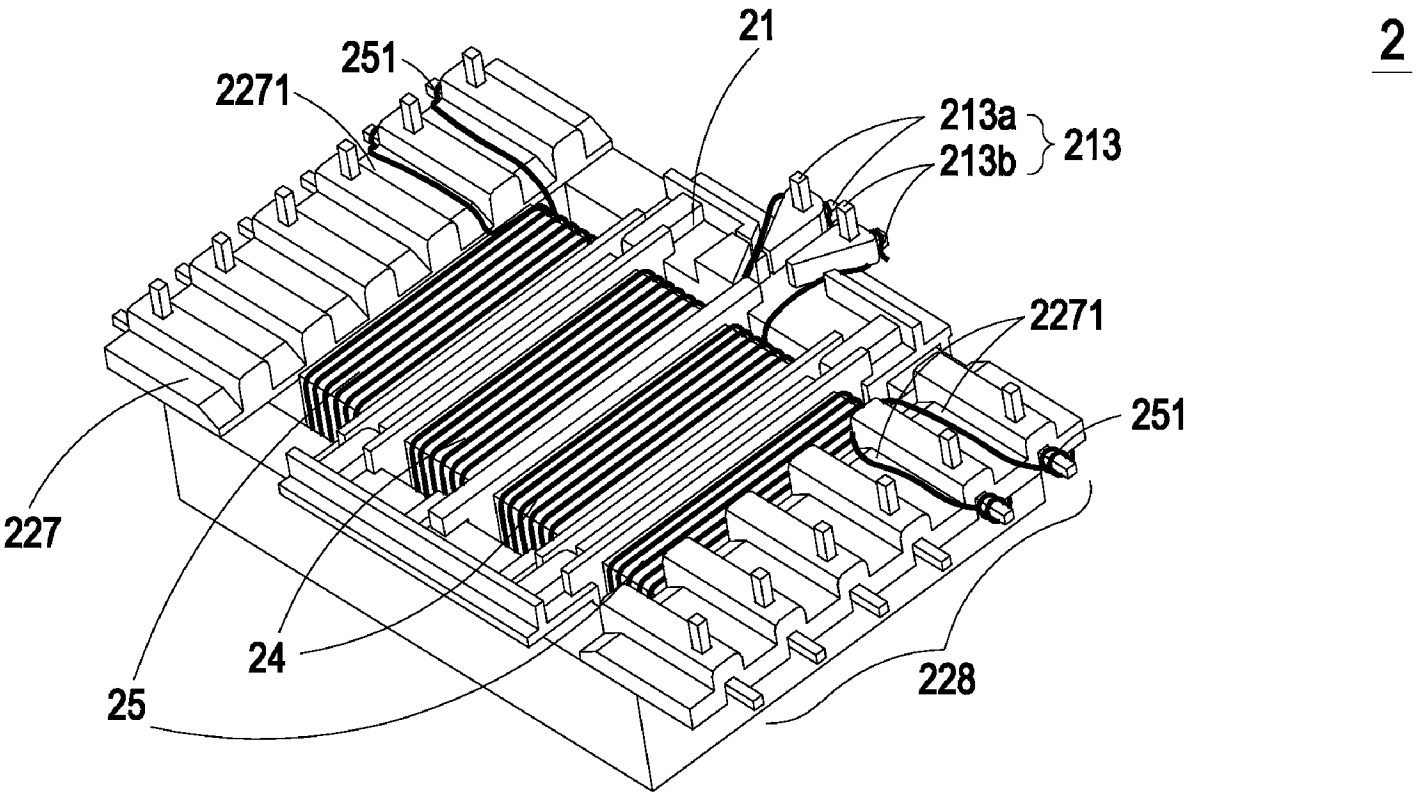
FIG. 2D is a schematic upside-down view illustrating the transformer of FIG. 2B.

FIG. 2D is a schematic upside-down view illustrating the transformer of FIG. 2B. As shown in FIG. 2D, each of the connecting base 227 has plural wire-managing grooves 2271. As the length of the wire-managing groove 2271 is increased, the safety distance between the pin 228 and the corresponding single-trough second winding section 223 is maintained. As such, the secondary winding coil 25 within the single-trough second winding section 223 fails to be stained with solder paste when the outer part 251 of the secondary winding coil 25 is soldered on the pin 228. In other words, the tubes used in the conventional transformer could be omitted according to the present invention.

From the above description, since the secondary winding coils are wound around respective single-trough second winding sections of the bobbin body, the transformer of the present invention has enhanced electric conversion efficiency. Since the outlet parts of the primary winding coil are fixed on the pins of the covering member, the winding space of the first winding section is increased and the heat generated during operation of the transformer is reduced. Moreover, since the single-trough second winding sections are arranged at bilateral sides of the first winding section, the air gap defined by the magnetic core assembly is disposed over the primary winding coil. Under this circumstance, the leakage inductance of the transformer could be stably controlled.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a covering member comprising plural pins;

a bobbin combined with said covering member, and comprising a bobbin body and a channel, wherein a first winding section and plural single-trough second winding sections are defined on said bobbin body, said single-trough second winding sections are arranged at bilateral sides of said first winding section, and said channel runs through said bobbin body;

a primary winding coil wound around said first winding section of said bobbin, and connected with said pins;

plural secondary winding coils wound around respective single-trough second winding sections of said bobbin; and a magnetic core assembly partially embedded into said channel of said bobbin.

2. The transformer according to claim 1 wherein said covering member further comprises:

a covering member body having a receptacle for accommodating a portion of said bobbin body and said primary winding coil; and a recess disposed beside said covering member body for partially accommodating said magnetic core assembly.

3. The transformer according to claim 1 wherein said bobbin further comprises:

two side plates disposed on two opposite sides of said bobbin body;

plural partition plates disposed on said bobbin body and arranged between said side plates; and two connecting bases respectively extended from external surfaces of said side plates, wherein said first winding section and said single-trough second winding sections are defined by said partition plates and said side plates.

4. The transformer according to claim 3 wherein said bobbin further comprises plural additional pins, which are extended from said connecting bases and connected with outlet parts of said secondary winding coils.

5. The transformer according to claim 1 wherein said first winding section of said bobbin is a single-trough winding section or a multi-trough winding section.

6. The transformer according to claim 5 wherein said bobbin further comprises a central separation plate for dividing said first winding section into a first portion and a second portion, so that first winding section is a multi-trough winding section.

7. The transformer according to claim 6 wherein said central separation plate has a notch, and said primary winding coil is allowed to be pass through said notch.

8. The transformer according to claim 1 wherein said magnetic core assembly comprises a first magnetic part and a second magnetic part.

9. The transformer according to claim 8 wherein each of said first magnetic part and said second magnetic part comprises a middle portion and two leg portions.

10. The transformer according to claim 8 wherein said magnetic core assembly is an EE-type magnetic core assembly, a UI-type magnetic core assembly or an EI-type magnetic core assembly.

11. The transformer according to claim 1 wherein said transformer is a resonant transformer.

* * * * *